US005378964A

United States Patent [19]

Kang

[11] Patent Number: 5,378,964

[45] Date of Patent: Jan. 3, 1995

[54] ELECTRONIC BALLAST CIRCUIT FOR DISCHARGE LAMPS

[75] Inventor: Bog Youn Kang, Cheongju, Rep. of Korea

[73] Assignee: Goldstar Instrument & Electric Co., Ltd., Seoul, Rep. of Korea

[21] Appl. No.: 156,818

[22] Filed: Nov. 24, 1993

[30] Foreign Application Priority Data

Nov. 1, 1993 [KR] Rep. of Korea ..... 23117/1993

[51] Int. Cl.[6] ..... H05B 41/24

[52] U.S. Cl. ..... 315/247; 315/254; 315/307; 315/DIG. 7

[58] Field of Search ..... 315/247, 246, 254, 255, 315/209 R, 244, 307, 291, 294, 210, 222, 272, 206, 172, 219, 173, 171, 227 R, 228, 200 R, DIG. 5, DIG. 7

[56] References Cited

U.S. PATENT DOCUMENTS 5,041,766 8/1991 Fiene et al. ..... 315/219

5,115,347 5/1992 Nilssen ..... 315/247

*Primary Examiner*—Ali Neyzari

*Attorney, Agent, or Firm*—Oliff & Berridge

[57] ABSTRACT

An electronic ballast circuit for discharge lamps, comprising a power factor enhancing and noise removing circuit for enhancing a power factor of an input AC voltage and removing a noise component therefrom, a rectification circuit for full wave-rectifying and smoothing an output voltage from the power factor enhancing and noise removing circuit to output a DC voltage, a drive voltage supply circuit having a primary winding of a first transformer for limiting current, the drive voltage supply circuit receiving the DC voltage from the rectification circuit, limiting an amount of current to a second transformer and supplying an initial drive voltage to an inverter, the second transformer driving the discharge lamps, a base driving circuit having a secondary winding of the first transformer, the base driving circuit supplying a voltage induced in a third winding of the second transformer and a current induced in the secondary winding of the first transformer as base drive voltage and current to the inverter, and a current control circuit for stabilizing a current induced in the second transformer and then supplied to the discharge lamps, the inverter driving the second transformer in response to the voltages from the rectification circuit and the base driving circuit.

1 Claim, 5 Drawing Sheets

ELECTRONIC BALLAST CIRCUIT FOR DISCHARGE LAMPS

BACKGROUND OF THE INVENTION

1. Field of the Invention

The present invention relates in general to the economy of energy in electronic ballast circuits of the self-excited generation type, and more particularly to an electronic ballast circuit for discharge lamps in which an inductance of a ferrite core is used to supply a stable transistor base current with no use of a separate direct current (DC) voltage source.

2. Description of the Prior Art

Generally, a high voltage is required to light discharge lamps such as fluorescent lamps in an initial state. After the lighting of the discharge lamps, an amount of current flowing through the discharge lamps must be controlled to maintain an illumination of the discharge lamps constant. This lighting characteristic of the discharge lamps requires the use of a ballast circuit.

Referring to FIG. 1, there is shown a circuit diagram of a conventional electronic ballast circuit for discharge lamps. As shown in this drawing, the conventional electronic ballast circuit comprises a rectification circuit 1 for full wave-rectifying and smoothing an input alternating current (AC) voltage to output a DC voltage, a drive voltage supply circuit 2 for receiving the DC voltage from the rectification circuit 1, limiting an amount of current to a transformer T3 and supplying an initial drive voltage to an inverter 4, and a base driving circuit 3 for dropping a voltage induced in a third winding L33 of the transformer T3 and the input AC voltage, full wave-rectifying and smoothing the dropped AC voltage and outputting the resultant DC voltage as a base drive voltage.

The inverter 4 is adapted to drive the transformer T3 in response to the DC voltages from the rectification circuit 1 and the base driving circuit 3.

A current control circuit 5 is also provided in the conventional electronic ballast circuit to stabilize a current induced in the transformer T3 and then supplied to the discharge lamps.

The operation of the conventional electronic ballast circuit with the above-mentioned construction will hereinafter be described.

Upon application of the input AC voltage to the rectification circuit 1, the input AC voltage is full wave-rectified by diodes D1–D4 and then smoothed by a condenser C1. As a result, the DC voltage is supplied from the condenser C1. The DC voltage from the condenser C1 is supplied to a base of a transistor Q1 in the inverter 4 through a turning-on resistor R1, thereby causing the transistor Q1 to be turned on. Because of the turning-on of the transistor Q1, a current flows through a current limiting transformer T1 in the drive voltage supply circuit 2, a primary winding L31 of the transformer T3 and the transistor Q1.

At this time supplied to a base of a transistor Q2 in the inverter 4 is a high voltage resulting from a voltage induced in the third winding L33 of the transformer T3, whereas a low voltage is supplied to the base of the transistor Q1. As a result, the transistor Q2 is turned on, while the transistor Q1 is turned off.

At that time that the transistor Q2 is turned on and the transistor Q1 is turned off, a current flows through the current limiting transformer T1, a secondary winding L32 of the transformer T3 and the transistor Q2, thereby causing a voltage to be induced in the third winding L33 of the transformer T3 in the opposite direction to that in the case where the primary winding L31 of the transformer T3 is driven as mentioned above. As a result, a high voltage is supplied to the base of the transistor Q1 and a low voltage is supplied to the base of the transistor Q2. In result, the transistor Q1 is turned on, while the transistor Q2 is turned off.

In this manner, the voltage induced in the third winding L33 of the transformer T3 is inverted in polarity whenever the primary winding L31 and the secondary winding L32 of the transformer T3 are alternately driven as the transistors Q1 and Q2 are alternately turned on. With the above operation repeated, a voltage is induced in a fourth winding L34 of the transformer T3 in proportion to the voltages induced in the primary winding L31 and the secondary winding L32 of the transformer T3. The voltage from the fourth winding L34 of the transformer T3 is supplied to the discharge lamp through condensers C4 and C5, resulting in a discharging operation.

By the way, in order to drive the transistors Q1 and Q2 more stably, a voltage is supplied to the bases of the transistors Q1 and Q2 separately from the voltage induced in the third winding L33 of the transformer T3. This separate voltage is supplied from the base driving circuit 3. Namely, in the base driving circuit 3, the input AC voltage is dropped by a predetermined level by a voltage dropping transformer T2. The dropped AC voltage is full wave-rectified by diodes D5-D8 and then smoothed by a condenser C2. As a result, the DC voltage is supplied from the condenser C2. The DC voltage from the condenser C2 is supplied to the bases of the transistors Q1 and Q2 respectively through current limiting resistors R2 and R3.

Referring to FIG. 2, there is shown a circuit diagram of another conventional electronic ballast circuit for discharge lamps. In operation, upon application of an input AC voltage, the input AC voltage is full wave-rectified by diodes D11–D14 and then smoothed by a condenser C11. As a result, a DC voltage is supplied from the condenser C11. The DC voltage from the condenser C11 is supplied to a base of a transistor Q11 through a turning-on resistor R11, thereby causing the transistor Q11 to be turned on. Because of the turning-on of the transistor Q11, a current flows through a current limiting transformer T11, a primary winding L41 of a transformer T4 and the transistor Q11.

At this time, the transistor Q11 and a transistor Q12 are alternately turned on by a voltage induced in a third winding L43 of the transformer T4, thereby causing a voltage to be induced in a fifth winding L45 of the transformer T4 in proportion to voltages induced in the primary winding L41 and a secondary winding L42 of the transformer T4. The voltage from the fifth winding L45 of the transformer T4 is supplied to the discharge lamp through condensers C14 and C15, resulting in a discharging operation.

FIG. 3A is a waveform diagram of a collector-emitter voltage of the transistor Q11, FIG. 3B is a waveform diagram of a base current of the transistor Q11 and FIG. 3C is a waveform diagram of a base voltage of the transistor Q11.

By the way, in order to drive the transistors Q11 and Q12 more stably, a voltage is supplied to the bases of the transistors Q11 and Q12 separately from the voltage induced in the third winding L43 of the transformer T4.

This separate voltage is supplied to the bases of the transistors Q11 and Q12 in a different manner from that in FIG. 1. Namely, a voltage is induced in a fourth winding L44 of the transformer T4 as the primary winding L41 and the secondary winding L42 of the transformer T4 are driven. The voltage from the fourth winding L44 of the transformer T4 is full wave-rectified by a diode D15 and then smoothed by a condenser C12. As a result, a DC voltage is supplied from the condenser C12. The DC voltage from the condenser C12 is supplied to the bases of the transistors Q11 and Q12 respectively through current limiting resistors R13 and R14.

However, in the conventional electronic ballast circuits, in order to stabilize the transistors of the inverter, the base driving circuit is provided with the transformer, the bridge diode, the condenser and the resistors as shown in FIG. 1 or the diode, the condenser and the resistors as shown in FIG. 2, resulting in a degradation in the efficiency of the ballast circuits and an increase in the cost.

SUMMARY OF THE INVENTION

Therefore, the present invention has been made in view of the above problems, and it is an object of the present invention to provide an electronic ballast circuit for discharge lamps in which a voltage is induced in a secondary winding of a current limiting inductor so that it can be supplied as a transistor base drive voltage.

In accordance with the present invention, the above and other objects can be accomplished by a provision of an electronic ballast circuit for discharge lamps, comprising power factor enhancing and noise removing means for enhancing a power factor of an input AC voltage and removing a noise component therefrom; rectification means for full wave-rectifying and smoothing an output voltage from said power factor enhancing and noise removing means to output a DC voltage; drive voltage supply means having a primary winding of a first transformer for limiting current, said drive voltage supply means receiving the DC voltage from said rectification means, limiting an amount of current to a second transformer and supplying an initial drive voltage to inverter means, said second transformer driving the discharge lamps; base driving means having a secondary winding of said first transformer, said base driving means supplying a voltage induced in a third winding of said second transformer and a current induced in the secondary winding of said first transformer as base drive voltage and current to said inverter means; and current control means for stabilizing a current induced in said second transformer and then supplied to the discharge lamps; said inverter means driving said second transformer in response to the voltages from said rectification means and said base driving means.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 4:
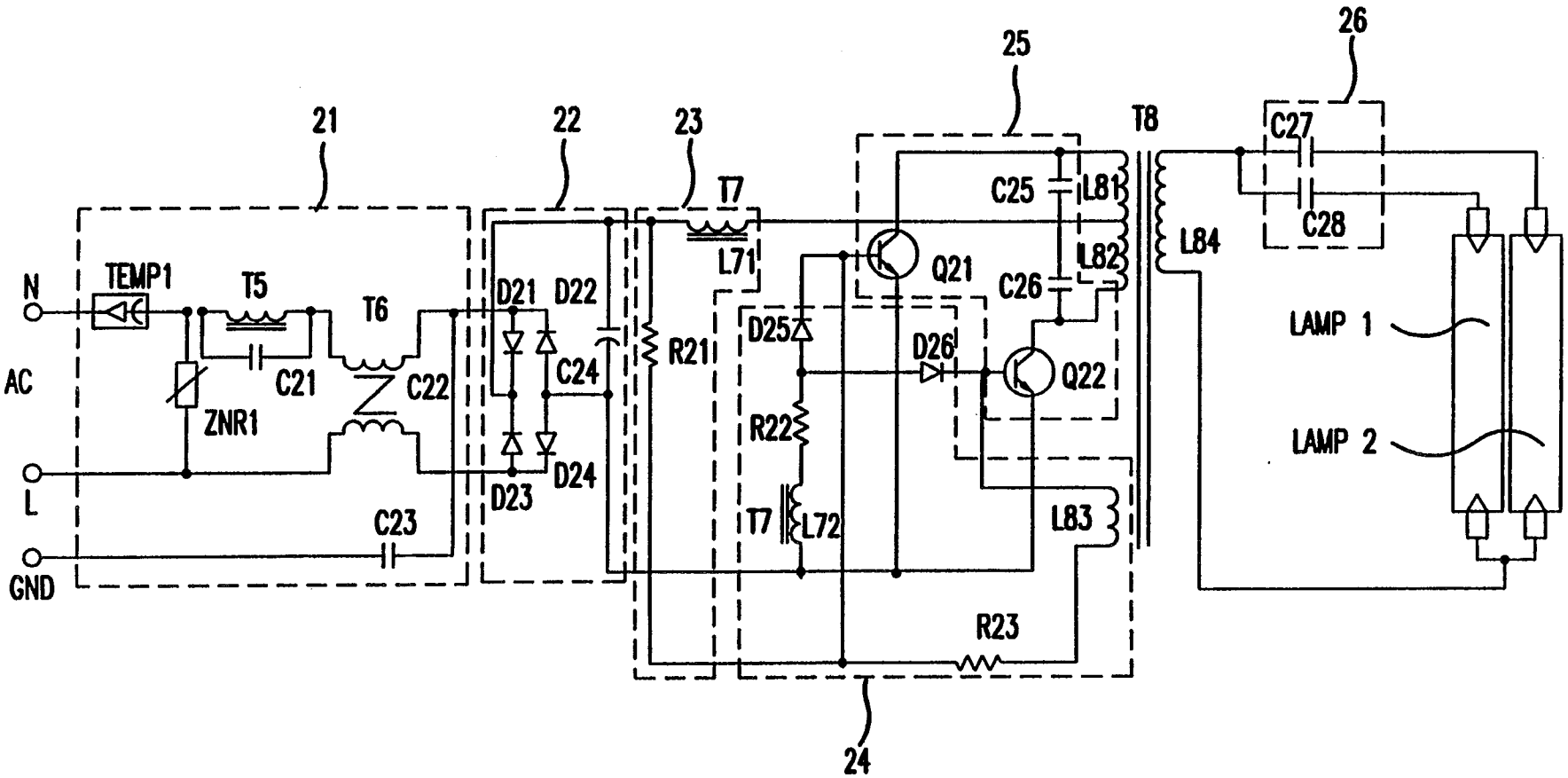
FIG. 4 is a circuit diagram of an electronic ballast circuit for discharge lamps in accordance with the present invention.

Referring to FIG. 4, there is shown a circuit diagram of an electronic ballast circuit for discharge lamps in accordance with the present invention. As shown in this drawing, the electronic ballast circuit comprises a power factor enhancing and noise removing circuit 21 for enhancing a power factor of an input AC voltage and removing a noise component therefrom, a rectification circuit 22 for full wave-rectifying and smoothing an output voltage from the power factor enhancing and noise removing circuit 21 to output a DC voltage, and a drive voltage supply circuit 23 for receiving the DC voltage from the rectification circuit 22, limiting an amount of current to a transformer T8 and supplying an initial drive voltage to an inverter 25.

A base driving circuit 24 is provided in the electronic ballast circuit to supply a voltage induced in a third winding L83 of the transformer T8 and a current induced a secondary winding L72 of a current limiting transformer T7 as base drive voltage and current to the inverter 25.

The inverter 25 is adapted to drive the transformer T8 in response to the voltages from the rectification circuit 22 and the base driving circuit 24.

A current control circuit 26 is also provided in the electronic ballast circuit to stabilize a current induced in the transformer T8 and then supplied to the discharge lamps.

The operation of the electronic ballast circuit with the above-mentioned construction in accordance with the present invention will hereinafter be described in detail with reference to FIGS. 5A to 5D.

Upon application of the input AC voltage to the power factor enhancing and noise removing circuit 21, an electric magnetic interface (EMI) noise of the input AC voltage is removed by transformers T5 and T6 and a condenser C21. The power factor of the noise-removed AC voltage is enhanced by a condenser C22. In the rectification circuit 22, the output voltage from the power factor enhancing and noise removing circuit 21 is full wave-rectified by diodes D21–D24 and then smoothed by a condenser C24. As a result, the DC voltage is supplied from the condenser C24. The DC voltage from the condenser C24 is supplied to the transformer T8 through the current limiting transformer T7. Also, the DC voltage from the condenser C24 is supplied to a base of a transistor Q21 of the inverter 25 through a resistor R21, thereby causing the transistor Q21 to be turned on.

Because of the turning-on of the transistor Q21, a current flows through a primary winding L71 of the transformer T7, a primary winding L81 of the transformer T8 and the transistor Q21. At this time, a voltage is induced in the third winding L83 of the transformer T8, thereby causing a high voltage to be applied to a base of a transistor Q22 of the inverter 25 and a low voltage to be applied to the base of the transistor Q21. As a result, the transistor Q22 is turned on, while the transistor Q21 is turned off.

As the transistor Q22 is turned on and the transistor Q21 is turned off, a current flows through the primary winding L71 of the transformer T7, a secondary winding L82 of the transformer T8 and the transistor Q22. At this time, a voltage is induced in the third winding L83 of the transformer T8 in the opposite direction to that in the case where the primary winding L81 of the transformer T8 is driven as mentioned above. As a result, a high voltage is supplied to the base of the transistor Q21 and a low voltage is supplied to the base of the transistor Q22. In result, the transistor Q21 is turned on, while the transistor Q22 is turned off.

In this manner, the voltage induced in the third winding L83 of the transformer T8 is inverted in polarity whenever the primary winding L81 and the secondary winding L82 of the transformer T8 are alternately driven as the transistors Q21 and Q22 are alternately turned on. Hence, a push-pull operation of the transistors Q21 and Q22 are repeatedly performed. At this time, a current is induced in the secondary winding L72 of the current limiting transformer T7 and then applied as the drive current to the bases of the transistors Q21 and Q22 so that the inverter 25 can be operated more stably.

Namely, when the high voltage is supplied to the base of the transistor Q21 and the low voltage is supplied to the base of the transistor Q22 by the voltage induced in the third winding L83 of the transformer T8, the transistor Q21 is turned on and the transistor Q22 is turned off. In this case, the current stored on the secondary winding L72 of the transformer T7 is supplied to the base of the transistor Q21 through a current limiting resistor R22, a diode D26, the third winding L83 of the transformer T8 and a resistor R23. As a result, the transistor Q21 is normally operated.

On the contrary, when the low voltage is supplied to the base of the transistor Q21 and the high voltage is supplied to the base of the transistor Q22 by the voltage induced in the third winding L83 of the transformer T8, the transistor Q21 is turned off and the transistor Q22 is turned on. In this case, the current stored on the secondary winding L72 of the transformer T7 is supplied to the base of the transistor Q22 through the current limiting resistor R22, a diode D25, the resistor R23 and the third winding L83 of the transformer T8. As a result, the transistor Q22 is normally operated.

Figure 1:
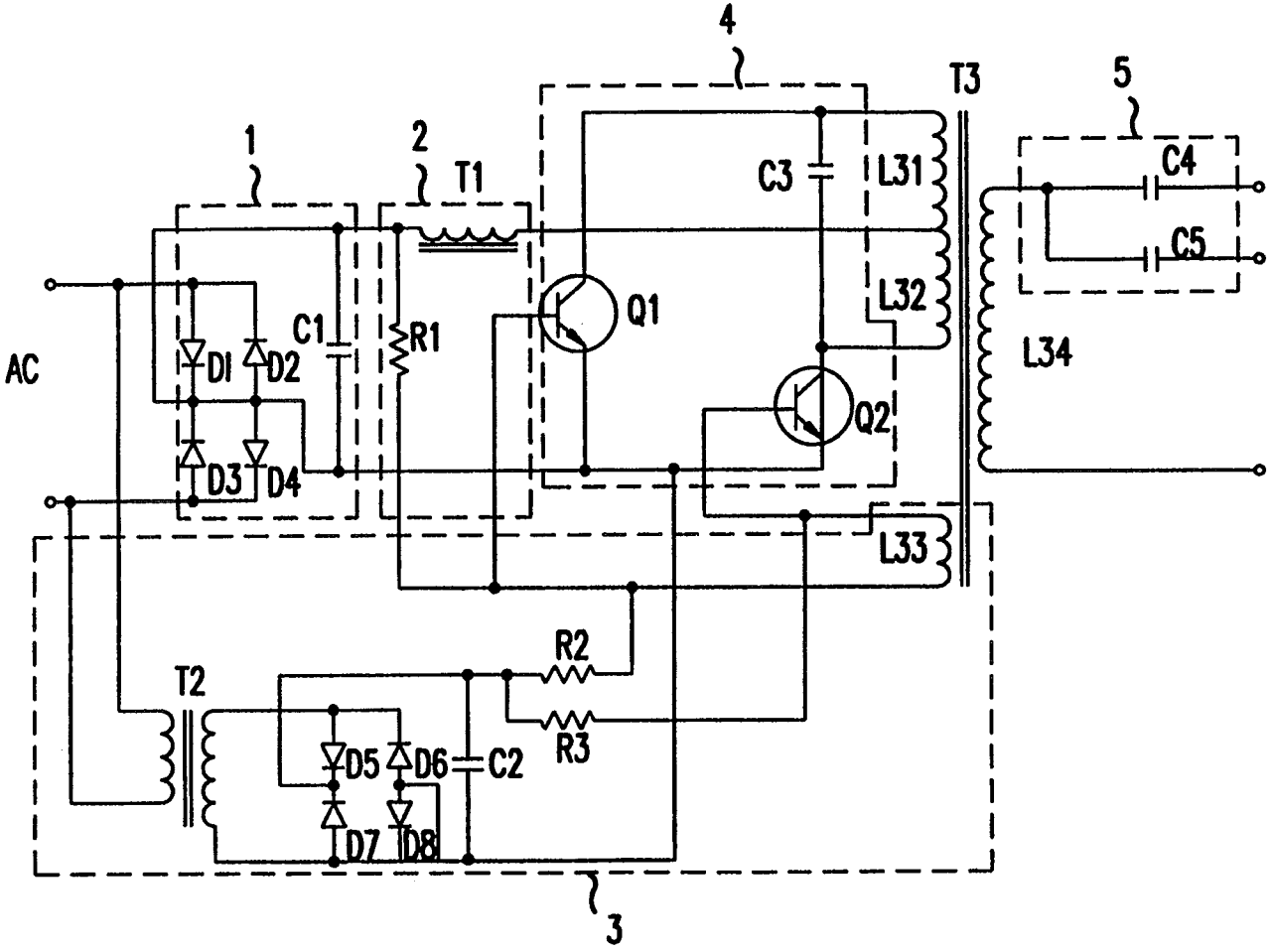
FIG. 1 CONVENTIONAL ART
FIG. 1 is a circuit diagram of a conventional electronic ballast circuit for discharge lamps.
Figure 2:
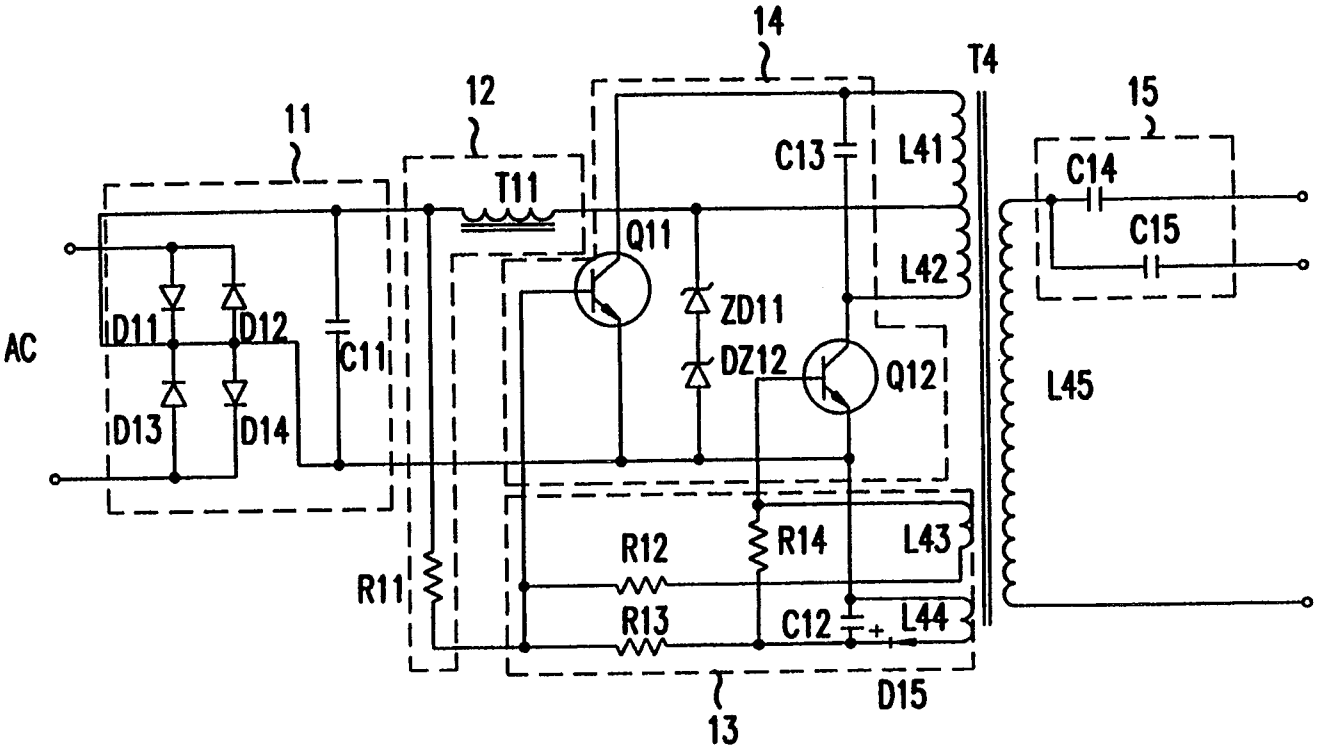
FIG. 2 CONVENTIONAL ART
FIG. 2 is a circuit diagram of another conventional electronic ballast circuit for discharge lamps.
Figure 3A:
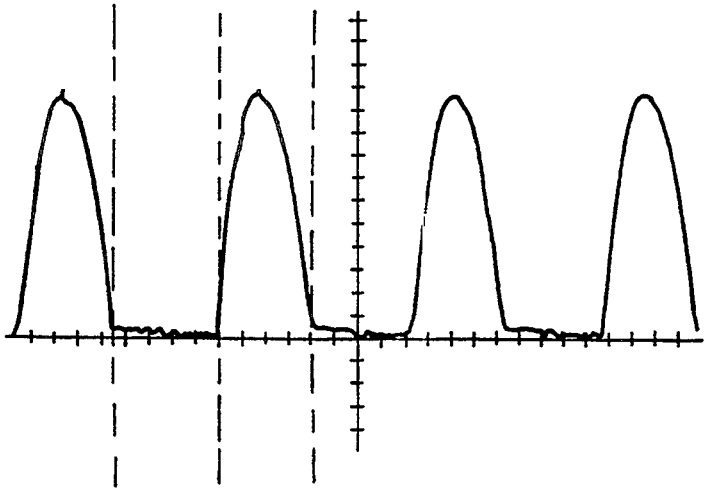
FIG. 3A CONVENTIONAL ART
FIG. 3A is a waveform diagram of a collector-emitter voltage of a transistor in FIG. 2.
Figure 3B:
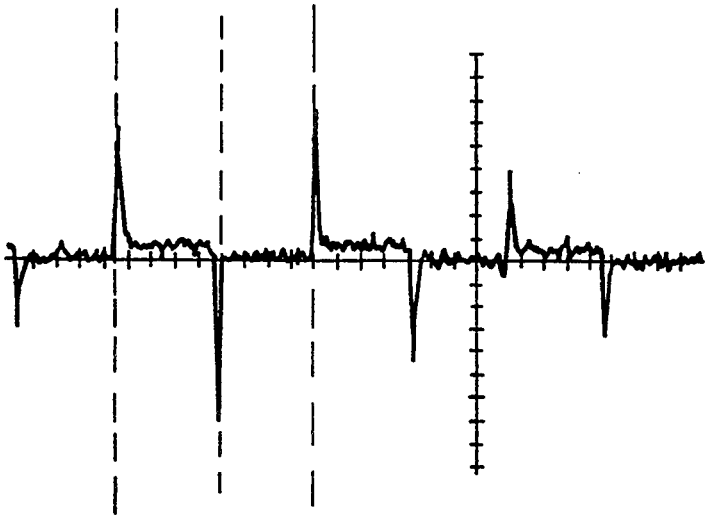
FIG. 3B CONVENTIONAL ART
FIG. 3B is a waveform diagram of a base current of the transistor in FIG. 2.
Figure 3C:
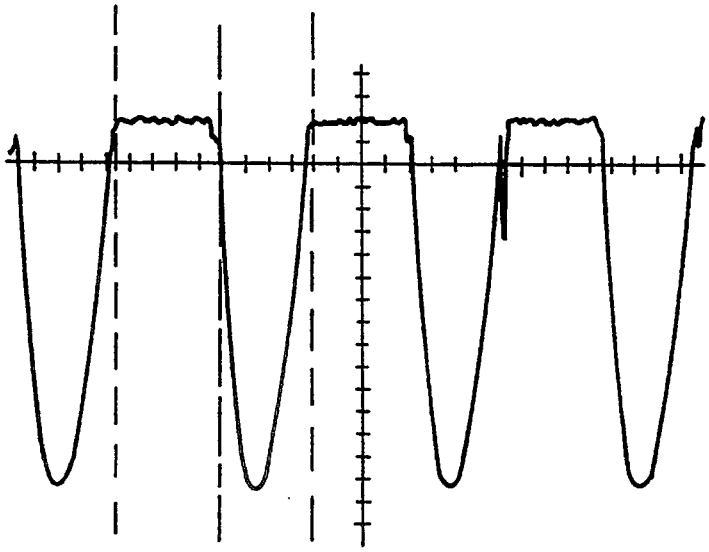
FIG. 3C CONVENTIONAL ART
FIG. 3C is a waveform diagram of a base voltage of the transistor in FIG. 2.
Figure 5A:
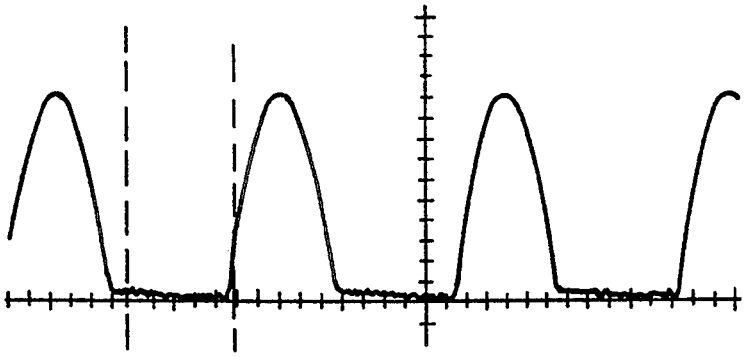
FIG. 5A is a waveform diagram of a collector-emitter voltage of a transistor in FIG. 4.
Figure 5B:
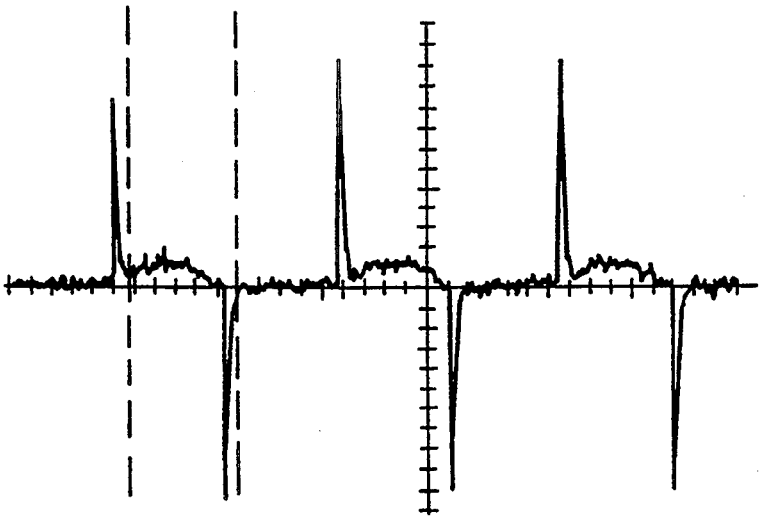
FIG. 5B is a waveform diagram of a base current of the transistor in FIG. 4.
Figure 5C:
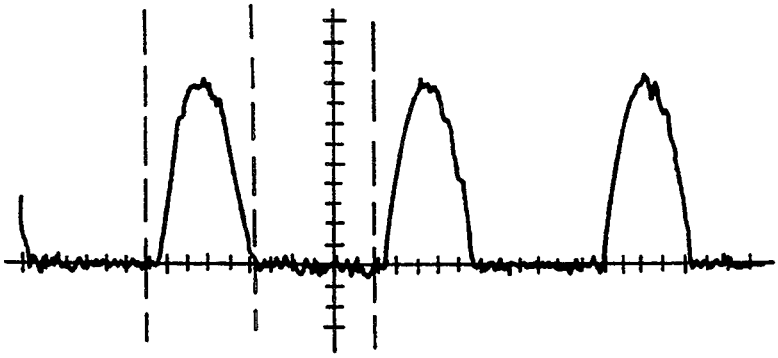
FIG. 5C is a waveform diagram of a base-current of a transistor in FIG. 4.
Figure 5D:
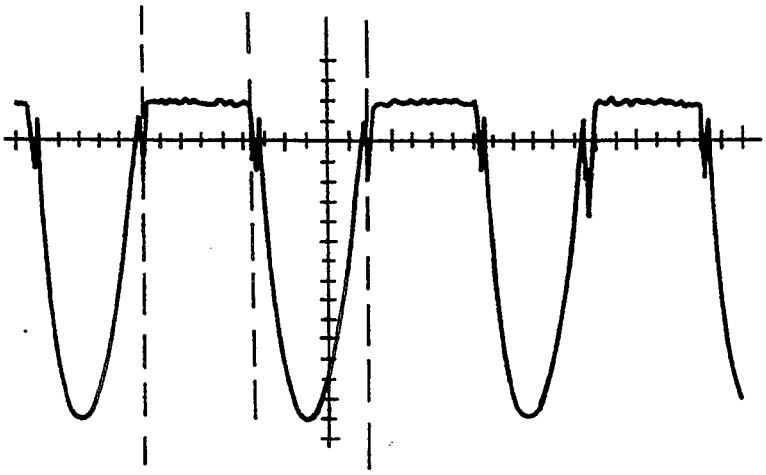
FIG. 5D is a waveform diagram of a base-emitter voltage of the transistor in FIG. 4.

FIG. 5A is a waveform diagram of a collector-emitter voltage $V_{CE.Q21}$ of the transistor Q21, FIG. 5B is a waveform diagram of a base current $I_{B.Q21}$ of the transistor Q21, FIG. 5C is a waveform diagram of a base-current $I_{B.Q22}$ of the transistor Q22 and FIG. 5D is a waveform diagram of a base-emitter voltage $V_{BE.Q21}$ of the transistor Q21. The waveforms in FIGS. 5A, 5B and 5D are substantially the same as those in the conventional transistor Q11 as shown in FIGS. 3A to 3C. However, it can be seen from FIG. 5B that the base current of a slightly curved wave flows when the transistor Q21 is turned on, differently from the DC as shown in FIG. 3B. Noticeably, the waveform of the base current in FIG. 5B is the same as that of the diode D26. Namely, the waveform of the base current in FIG. 5B is to enlarge the waveform of the current of the diode D26 by 10 times.

As apparent from the above description, according to the present invention, the voltage induced in the secondary winding of the current limiting transformer can alternately be supplied to the transistors of the inverter. Therefore, the inverter can be stabilized with the cost reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electronic ballast circuit for discharge lamps, comprising:

power factor enhancing and noise removing means for enhancing a power factor of an input AC voltage and removing a noise component therefrom:

rectification means for full wave-rectifying and smoothing an output voltage from said power factor enhancing and noise removing means to output a DC voltage;

drive voltage supply means having a primary winding of a first transformer for limiting current, said drive voltage supply means receiving the DC voltage from said rectification means, limiting an amount of current to a second transformer and supplying an initial drive voltage to inverter means, said second transformer driving the discharge lamps;

base driving means having a secondary winding of said first transformer, said base driving means supplying a voltage induced in a third winding of said second transformer and a current induced in the secondary winding of said first transformer as base drive voltage and current to said inverter means; and current control means for stabilizing a current induced in said second transformer and then supplied to the discharge lamps;

said inverter means driving said second transformer in response to the voltages from said rectification means and said base driving means;

wherein said base driving means includes the secondary winding of said first transformer, said secondary winding of said first transformer having one side connected commonly to emitters of a first transistor and a second transistor and the other side connected to a base of said first transistor of said inverter means through a first resistor and a first diode and to a base of said second transistor of said inverter means and one side of the third winding of said second transformer through said first resistor and a second diode, said third winding of said second transformer having the other side connected to the base of said first transistor through a second resistor.

* * * * *